US008528268B1

(12) United States Patent
Reaves

(10) Patent No.: US 8,528,268 B1
(45) Date of Patent: Sep. 10, 2013

(54) TRILATERAL BRACING STRUCTURE FOR REINFORCING A BUILDING FRAME STRUCTURE

(75) Inventor: Tom Reaves, Sioux Falls, SD (US)

(73) Assignee: Component Manufacturing Company, Sioux Falls, SD (US)

( * ) Notice: Subject to any disclaimer, the term of this patent is extended or adjusted under 35 U.S.C. 154(b) by 27 days.

(21) Appl. No.: 12/958,520

(22) Filed: Dec. 2, 2010

(51) Int. Cl.
*E04B 7/04* (2006.01)

(52) U.S. Cl.
USPC ..... 52/93.1; 52/92.2; 52/693; 52/695

(58) Field of Classification Search
USPC ..... 52/92.2, 93.1, 94, 636, 639, 693, 52/695
See application file for complete search history.

(56) References Cited

U.S. PATENT DOCUMENTS

| | | | | | |
|---|---|---|---|---|---|
| 114,039 | A | | 4/1871 | Pratt | |
| 1,046,910 | A | * | 12/1912 | Wagner | 52/15 |
| 1,622,962 | A | | 3/1927 | Michod | |
| 1,748,794 | A | | 2/1930 | Ray | |
| 2,856,646 | A | | 10/1958 | Latimer | |
| 3,156,018 | A | * | 11/1964 | Slayter | 52/73 |
| 3,293,808 | A | * | 12/1966 | Duncan | 52/92.2 |
| 3,601,939 | A | * | 8/1971 | Clyne et al. | 52/93.1 |
| 3,664,513 | A | * | 5/1972 | Atwater | 211/134 |
| 3,708,928 | A | * | 1/1973 | Gaspers | 52/93.1 |
| 4,030,256 | A | * | 6/1977 | Ollman | 52/93.1 |
| 4,292,775 | A | | 10/1981 | Howard | |
| 4,294,050 | A | | 10/1981 | Kandel | |
| 4,317,316 | A | * | 3/1982 | Atwood et al. | 52/93.1 |
| 4,437,273 | A | * | 3/1984 | Helfman | 52/93.2 |
| 4,441,287 | A | * | 4/1984 | Muir | 52/93.2 |
| 4,479,342 | A | * | 10/1984 | Eberle | 52/741.14 |
| 4,514,950 | A | | 5/1985 | Goodson | |
| 4,558,713 | A | | 12/1985 | Hagler | |
| 4,648,216 | A | * | 3/1987 | Reaves et al. | 52/93.1 |
| 4,656,792 | A | * | 4/1987 | Clark | 52/93.1 |
| 4,887,406 | A | * | 12/1989 | Saia | 52/694 |
| 4,982,545 | A | * | 1/1991 | Stromback | 52/639 |
| 5,067,299 | A | | 11/1991 | French | |
| 5,301,486 | A | * | 4/1994 | Taylor | 52/695 |
| 5,313,756 | A | * | 5/1994 | Ways et al. | 52/263 |
| 5,341,611 | A | | 8/1994 | Lewis | |
| 5,363,626 | A | * | 11/1994 | Hanninen | 52/639 |
| 5,468,086 | A | * | 11/1995 | Goya | 403/260 |
| 5,592,789 | A | * | 1/1997 | Liddell et al. | 52/63 |
| 5,617,693 | A | * | 4/1997 | Hefner | 52/693 |

(Continued)

FOREIGN PATENT DOCUMENTS

| | | |
|---|---|---|
| EP | 48624 | 3/1982 |
| JP | 01256637 | 10/1989 |

(Continued)

*Primary Examiner* — Basil Katcheves
*Assistant Examiner* — Joshua Ihezie
(74) *Attorney, Agent, or Firm* — Jeffrey A. Proehl; Woods, Fuller, Schultz & Smith, P.C.

(57) ABSTRACT

A building assembly for forming a frame of a building including at least two elongated column structures and a truss structure supported on the column structures. The truss structure has opposite end portions resting on the column structures at horizontally spaced locations. A trilateral bracing structure may be attached to the truss structure and one of the column structures to tie the truss structure to the column structure. The trilateral bracing structure may be separable from the truss structure and the column structure.

16 Claims, 3 Drawing Sheets

(56) References Cited

U.S. PATENT DOCUMENTS

| | | | | |
|---|---|---|---|---|
| 5,649,403 | A * | 7/1997 | Haisch | 52/693 |
| 5,657,606 | A * | 8/1997 | Ressel et al. | 52/690 |
| 5,666,766 | A * | 9/1997 | Markey | 52/94 |
| 5,735,087 | A * | 4/1998 | Olden | 52/92.2 |
| 5,890,339 | A * | 4/1999 | Willis | 52/640 |
| 5,904,025 | A | 5/1999 | Bass | |
| 6,050,033 | A * | 4/2000 | Wrightman | 52/93.1 |
| 6,073,413 | A * | 6/2000 | Tongiatama | 52/693 |
| 6,148,574 | A * | 11/2000 | Chapman | 52/289 |
| 6,158,184 | A | 12/2000 | Timmerman | |
| 6,240,695 | B1 * | 6/2001 | Karalic et al. | 52/690 |
| 6,308,469 | B1 | 10/2001 | Leung | |
| 6,460,297 | B1 | 10/2002 | Bonds | |
| 6,481,176 | B2 * | 11/2002 | Snow | 52/639 |
| 6,694,699 | B2 * | 2/2004 | Dowland | 52/741.13 |
| 7,251,920 | B2 * | 8/2007 | Timmerman et al. | 52/800.13 |
| 7,360,341 | B2 * | 4/2008 | Jackson et al. | 52/693 |
| 8,240,106 | B2 | 8/2012 | Cloyd | |
| 2002/0108332 | A1 | 8/2002 | Timmerman | |
| 2007/0193130 | A1 | 8/2007 | Sopp | |
| 2008/0245017 | A1 | 10/2008 | Hawes | |
| 2010/0115876 | A1 | 5/2010 | Cloyd | |
| 2010/0313516 | A1 | 12/2010 | Kreller | |

FOREIGN PATENT DOCUMENTS

| | | |
|---|---|---|
| JP | 02197637 | 8/1990 |
| JP | 03087436 | 4/1991 |
| JP | 04330134 | 11/1992 |
| JP | 05044351 | 2/1993 |
| JP | 06306937 | 11/1994 |
| JP | 06322827 | 11/1994 |

* cited by examiner

TRILATERAL BRACING STRUCTURE FOR REINFORCING A BUILDING FRAME STRUCTURE

BACKGROUND

1. Field

The present disclosure relates to pre-assembled structures for buildings and more particularly pertains to a new trilateral bracing structure for reinforcing a building frame structure that utilizes generally standard column and truss structures.

2. Description of the Prior Art

Knee braces have been implemented in the frames of building structures, particularly those formed of wood boards, to increase the strength and rigidity of the frame of the building. Elements have been integrated into the structure of a roof truss to provide some of the benefits of the knee brace, such as was disclosed in U.S. Pat. No. 4,648,216 to Reaves (which is hereby incorporated by reference in its entirety) to provide greater strength and rigidity in the connection to a column structure of the building frame. While highly useful, such approaches require specially configured trusses that are different from the commonly manufactured truss configuration, and thus such truss structures must be specially made for structures that are to incorporate this feature, which in turn can mean higher manufacturing costs and can add to inventory levels.

SUMMARY

In view of the foregoing, the present disclosure describes a new a new trilateral bracing structure for reinforcing a building frame structure that utilizes generally standard column and truss structures that may not have been specially configured for use with the trilateral bracing structure.

In one aspect, the present disclosure relates to a building assembly for forming a frame of a building. The building assembly may comprise at least two elongated column structures, a truss structure supported on the column structures and having opposite end portions resting on the column structures at horizontally spaced locations, and a trilateral bracing structure attached to the truss structure and one of the column structures to tie the truss structure to the column structure. The trilateral bracing structure may be separable from the truss structure and the column structure.

In another aspect, the disclosure relates to a kit for forming a frame of a building. The kit may comprise at least two elongated column structures, with the at least one column structure including at least two board elements. The kit may also include a truss structure supportable on the column structures, with the truss structure having opposite end portions restable on the column structures at horizontally spaced locations. The kit may also include a trilateral bracing structure for attachment to the truss structure and one of the column structures to tie the truss structure to the column structure. The trilateral bracing structure may be a separate piece from the truss structure and the column structure.

There has thus been outlined, rather broadly, some of the more important elements of the invention in order that the detailed description thereof that follows may be better understood, and in order that the present contribution to the art may be better appreciated. There are additional elements of the invention that will be described hereinafter and which will form the subject matter of the claims appended hereto.

In this respect, before explaining at least one embodiment or implementation in greater detail, it is to be understood that the scope of the invention is not limited in its application to the details of construction and to the arrangements of the components, and particulars of the steps, set forth in the following description or illustrated in the drawings. The invention is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present invention.

The advantages of the various embodiments of the present invention, along with the various features of novelty that characterize the invention, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

With reference now to the drawings, and in particular to FIGS. 1 through 5 thereof, a new trilateral bracing structure for reinforcing a building frame structure embodying the principles and concepts of the disclosed subject matter will be described.

Applicants have recognized that while knee brace or V-brace structures such as those disclosed in U.S. Pat. No. 4,648,216 are highly beneficial for reinforcing and strengthening the frame structure of a building, the use of such structures may require the use of specialized truss structures that can limit the ability of the builder to utilize such knee brace structures when such specialized trusses are not available, and the specialized nature of the trusses may increase the cost of manufacturing and utilizing such structures. Applicants have invented a new trilateral bracing structure that provides many of the benefits of a knee brace or V-brace structure while utilizing column structures and truss structures that are not specially adapted or configured or altered to incorporate a knee brace structure. As a result of this development, applicants have devised a system that allows the use of a trilateral bracing structure on a building frame utilizing non-specialized column and truss structures.

Further, applicants have recognized that while the strength and rigidity advantages provided by a knee brace or V-brace structure may be needed at some points in the life of the building, such as when the building is being constructed, the benefits of the brace may not always be needed, such as after the frame structure is complete and the building is substantially fully enclosed and ready for occupancy. As a result of this realization, applicants have devised a new trilateral bracing structure that allows for a non-permanent and temporary use of a trilateral bracing structure on the frame of the structure of a building. To this end, the trilateral bracing structure is not integrated into the truss structure or the column structure which allows the bracing structure to be removed from the column and truss structures after the building assembly has been completed, if the bracing structure is not necessary for strength and rigidity.

Figure 1:
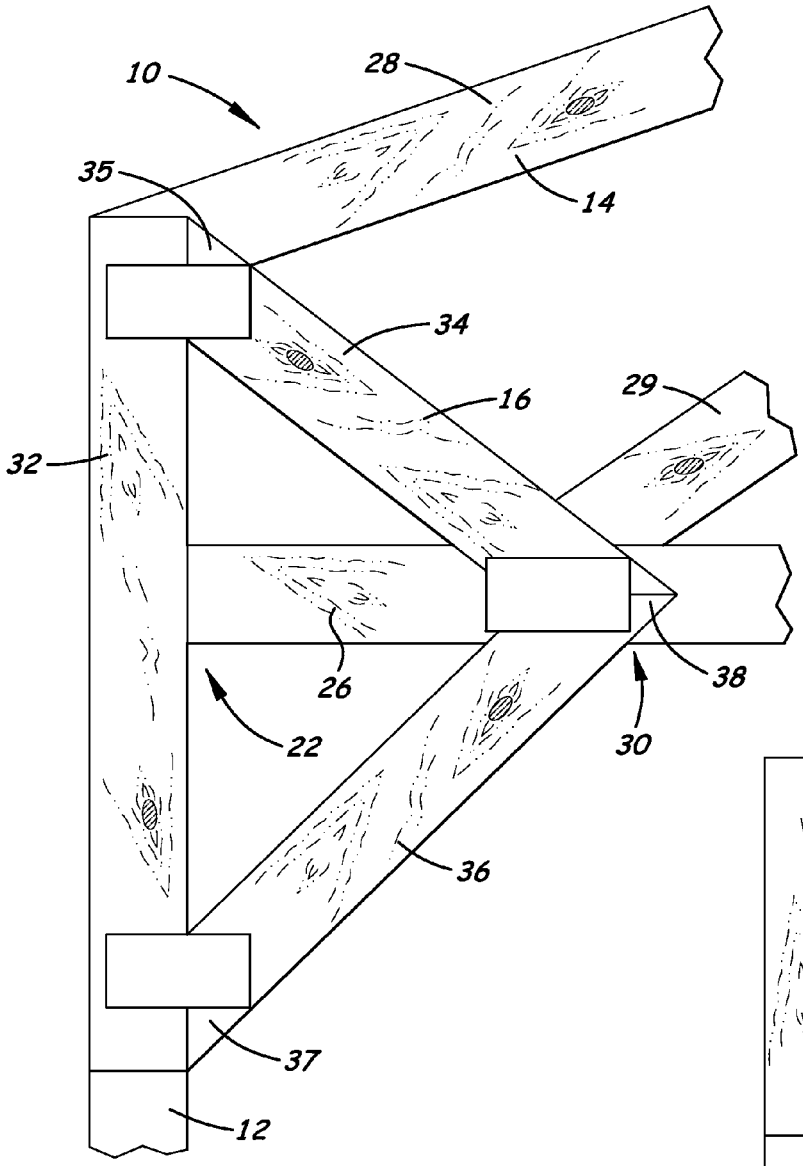
FIG. 1 is a schematic front view of a new trilateral bracing structure according to the present disclosure mounted on a column structure and a truss structure in a building frame.
Figure 2:
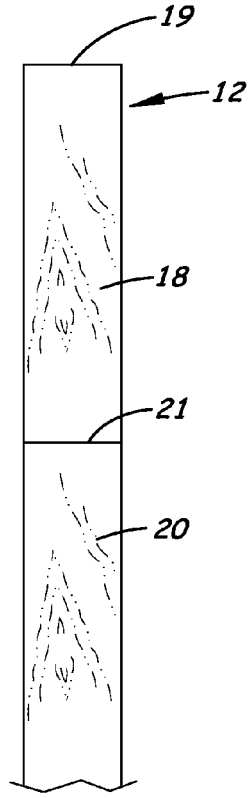
FIG. 2 is a schematic front view of the column structure.
Figure 3:
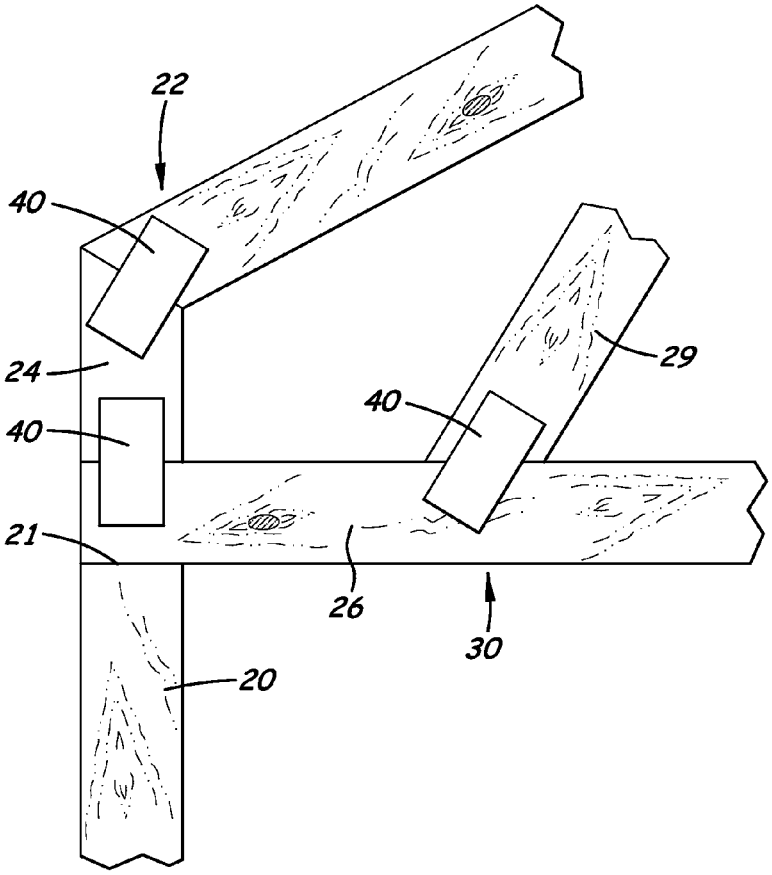
FIG. 3 is a schematic front view of the column structure and the truss structure mounted on the column structure.
Figure 4:
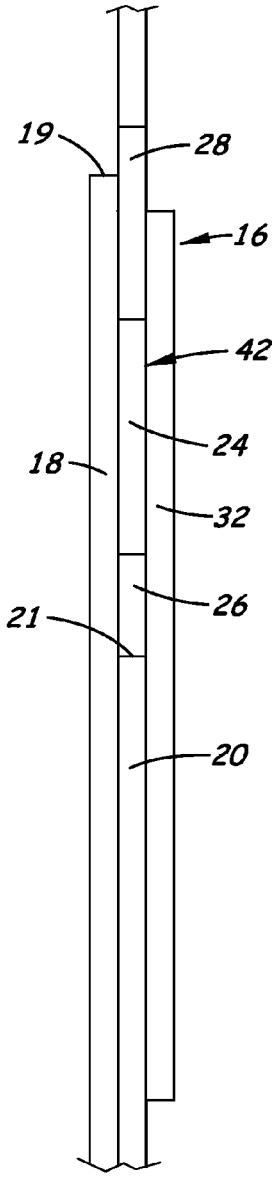
FIG. 4 is a schematic side view of the column structure, truss structure and trilateral bracing structure in the building frame.
Figure 5:
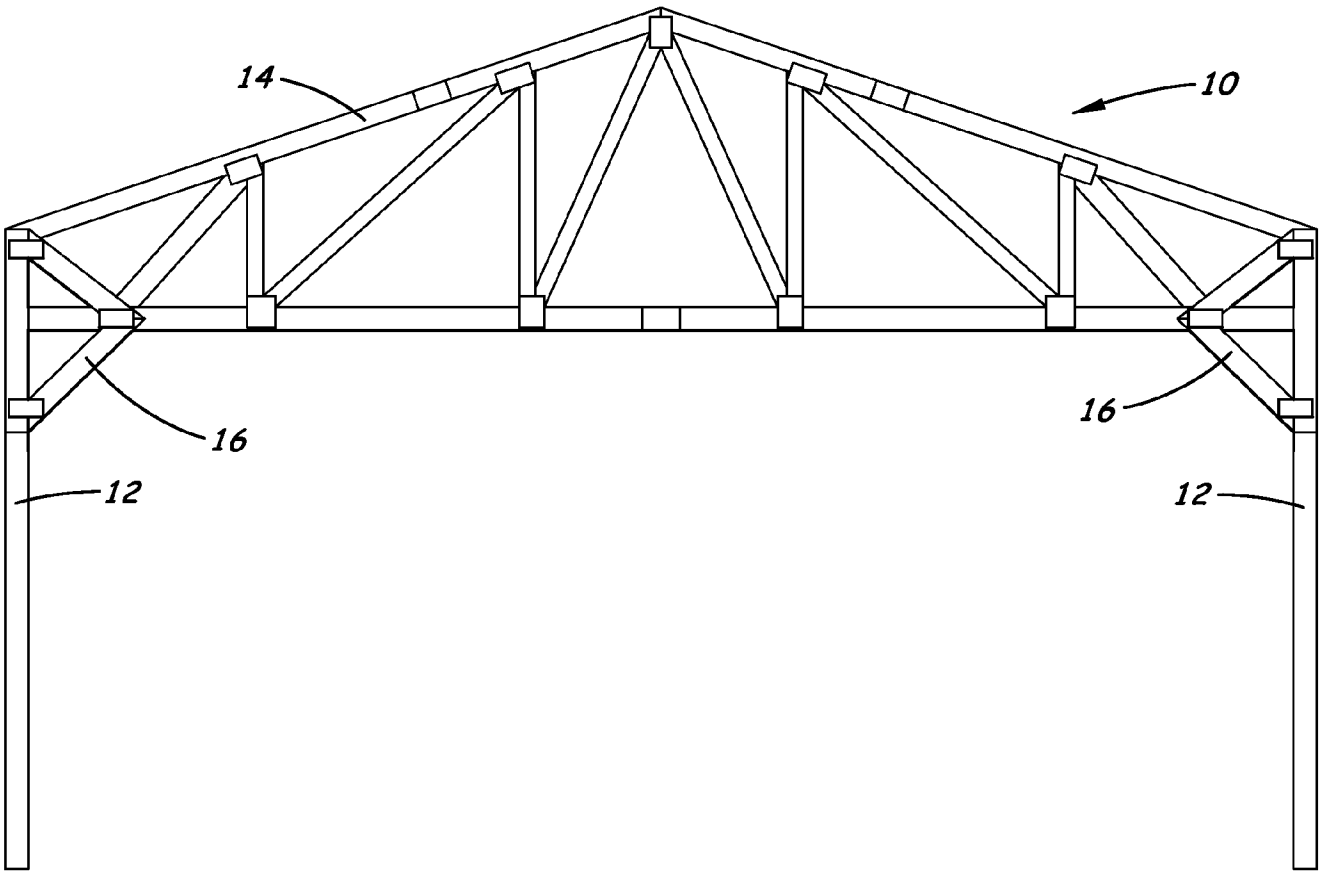
FIG. 5 is a schematic front view of a pair of the column structures, a truss structure supported on the column structures, and a pair of the trilateral bracing structures mounted on the truss structure and column structures.

Aspects of the disclosure relate to structures that may be implemented in a building assembly 10 to form a portion of the frame of a building structure. In general, the structures of the building assembly 10 may include at least one column structure 12, at least one truss structure 14, and at least one trilateral bracing structure 16 that may be assembled together to form a portion of the frame or skeleton of a building. An illustrative building assembly is depicted in FIG. 4 of the drawings, with portions of the assembly 10 being shown in the other drawing figures.

In greater detail, the elongated column structure 12 may be oriented substantially vertical in use in the frame of a building. Typically a building frame includes a plurality of the column structures, and a pair of the column structures may be utilized to support a truss structure in the building assembly 10 in an elevated condition. Each of the column structures may include at least two board elements 18, 20, although additional board elements may be utilized. The two board elements 18, 20 may be positioned face to face in the column structure, and may be of similar nominal dimensions (other than the length dimension, which is discussed below). When positioned in the column structure, an upper end 19 of the first board element may have a vertical height that is higher than a vertical height of an upper end 21 of a second board element 22, and when the board elements are positioned face to face, a partial pocket may be formed by the board elements of unequal length. Each of board elements may have a length, such that the first board element has a first vertical length and the second board element has a second vertical length, which may be accomplished by utilizing a first board element that is longer than the second board element.

The truss structure 14 may be supported on the column structures, with each end portion 22 of the truss structure being supported by one of the column structures. The opposite end portions 22 of the truss structure 14 may be horizontally spaced when the truss structure is positioned in a building assembly. At least one of the end portions 22 may include a substantially vertical end element 24. The truss structure 14 may include a bottom chord element 26, and the chord element 26 may be rested upon the upper end 21 of the second board element 20 of the column structure 12. The end element 24 of the truss structure may be positioned in substantial vertical alignment with the second board element 20 of the column structure. At least a portion of the end element 24 of the truss structure 14 may be positioned adjacent to the first board element 18 of the column structure 12, and may be positioned against the first board element, and may be fastened to the board element in the building assembly. The truss structure 14 may also include a top chord element 28 that extends from the end element 24 toward an opposite end portion of the truss structure. The truss structure 14 may also include at least one web element 29 that extends from the bottom chord element 26 to the top chord element 28, or between the top or bottom chord and another web element. Typically, the truss structure will include two top chords that converge at an upper apex, and a plurality of web elements, although the number and relationship of these elements is not critical.

The trilateral bracing structure 16 may function to further structurally tie the truss structure 14 to the column structure 12 when the bracing structure is attached to the column structure and the truss structure to form a portion of the building assembly 10 of the building frame. The trilateral bracing structure 16 may be attached to the column structure 12 and attached to the truss structure 14 to provide the tying function. The trilateral bracing structure 12 may extend to a mounting location 30 on the bottom element 26 of the truss structure that is horizontally-spaced from the end element 24 of the truss structure. At least one location on the trilateral bracing structure 16 may be attached to the truss structure 14 at the mounting location, and that mounting location is horizontally spaced from the column structure 12 when the structures are assembled in the assembly 10. A portion of the trilateral bracing structure 16 may extend vertically above the bottom chord 26 of the truss structure and a portion of the trilateral bracing structure 16 may extend vertically below the bottom chord of the truss structure. In some preferred embodiments, the bracing structure 16 does not extend directly below or under the truss structure 14.

The trilateral bracing structure 16 may have three sides, and significantly may have three mounting locations for mounting or attaching the bracing structure 16 to locations on the column structure and the truss structure. In some embodiments, the trilateral bracing structure has three apexes or corners at which the bracing structure 16 is attached or fastened to the other structures 12, 14, although some or all of the mounting locations may be located along the sides of the bracing structure between the apexes. In greater detail, the trilateral bracing structure 16 may comprise a bridging element 32, which may be substantially vertically oriented when the trilateral bracing structure 16 is attached to the column structure 12 and the truss structure 14 in the frame of a building. The bridging element 32 may bridge across a portion of the column structure 12 and a portion of the truss structure 14 when the trilateral bracing structure 16 is attached to the column and truss structures in the building assembly. The bridging element 32 may abut against the first board element 18 of the column structure, and may also abut against the end element 24 of the truss structure. The bridging element 32 may have a length, and in some implementations approximately one-half of the length of the bridging element may be abutted against the column structure 12 and approximately one-half of the length may be abutted against the truss structure, although variations from these approximate relationships may be utilized. The bridging element 32 may also extend in substantial vertical alignment with the second board element of the column structure.

The trilateral bracing structure 16 may also comprise a first element 34 and a second element 36 that are attached together in a V-shaped configuration with an apex 38. The area of the V-shape configuration at or near the apex may be attached to the bottom chord element 26 of the truss structure at the mounting location that is horizontally spaced from the column structure 12. The ends 35, 37 of the respective first 34 and second 36 elements of the V-shape configuration may be attached to the bridging element 32 such that a lower end 37 of the second element of the trilateral bracing structure is attached to the column structure 12 below the bottom chord element 26 of the truss structure, and an upper end 35 of the first element 34 of the trilateral bracing structure is attached to the truss structure 14 at a location that is above the bottom chord of the truss structure. The upper end 35 of the first element may be attached to the end element 24 of the truss structure and/or may be attached to the top chord. The first element 34 and the second element 36 may each be angled at an angle with respect to the bridging element 32. In some preferred embodiments, the second element 36 of the trilateral bracing is longitudinally, or substantially longitudinally, aligned with one of the web elements. A first angle may be formed between the first element 34 and the bridging element 32 and a second angle may be formed between the second element 36 and the bridging element 32. In some embodiments, the first angle and the second angle are substantially equal in measure. The first and second angles may measure between approximately 30 and approximately 60 degrees with respect to the bridging element, and in some of the more preferred embodiments, the first and second angles measure approximately 45 degrees.

The first, second, and bridging elements of the trilateral bracing structure 16 may each be formed of a separate piece or component, such as a wood or composite board, and may be connected together by connecting plates 40 that extend across two or more components and include a plurality of protruding barbs that are driven into the surfaces of the components to create a mechanical connection therebetween, although any suitable connection or bonding technology known or developed may be utilized for this purpose. Optionally, the trilateral bracing structure may be formed of a single piece of material. The trilateral bracing structure 16 may be attached to the column structure 12 and the truss structure using fasteners such as nails or screws or other suitable fastening or bonding technology.

In the most preferred embodiments, the trilateral bracing structure 16 does not form an integral part of the column structure 12 or the truss structure 14 so that the truss structure 14 is supportable on the column structure 12 in the assembled building frame without the presence of the trilateral bracing structure. In this way, the trilateral bracing structure 16 may be mounted on the column structure and the truss structure during the time of assembly of the frame of the building, and may be unfastened and removed from the column and truss structure after completion of the frame or may be left in attachment to the column and truss structure after completion of the frame structure.

Significantly, the trilateral bracing structure 16 may form a pocket 42 with the column structure when mounted on the column structure that receives the end portion 22 of the truss structure. In forming the pocket 42, the bridging element 32 may be spaced from the first board element 18 of the column structure by the second board element 20 to which the bridging element 32 is mounted. At least a portion of the end element 24, the bottom chord element 26 and the top chord element 28 of the truss structure may then be positioned between the bridging element 32 and the first board element 18.

Utilization of the trilateral bracing structure of the disclosure allows the building frame to include the benefits of having a knee brace in the frame without having to utilize specialized truss structures or specialized column structures, and thus less specialized (and sometimes less expensive) truss and column structures may be utilized for the building assemblies of the frame structure. The benefits of the knee brace may thus be utilized during assembly of the frame, and may also be utilized after the assembly of the frame.

A building may comprise a frame that includes a plurality of column structures 12, a plurality of truss structures 14, and a plurality of trilateral bracing structures 16. These structures may be preformed or prefabricated prior to movement of the structures to the location where the components of the building are to be assembled. Assembly of the frame may include erection of the column structures in a substantially vertical orientation, positioning of a truss structure on one or more of the column structures, and mounting of the trilateral bracing structure to the column and truss structure. Optionally, prior to placement of the truss structure, the trilateral bracing structure may be mounted to an erected column structure to form a pocket therebetween so that a portion of the truss structure may be inserted into the pocket 42 so formed. Optionally, upon completion or substantial completion of the building, one or more of the trilateral bracing structures may be removed from the frame if the strength and rigidity provided by the bracing structure 16 is no longer needed, and the bracing structure may be reused on another building frame during assembly.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A building assembly for forming a frame of a building, the building assembly comprising:

at least two elongated column structures;

a truss structure supported on the column structures, the truss structure having opposite end portions resting on the column structures at horizontally spaced locations; and a trilateral bracing structure attached to the truss structure and one of the column structures to tie the truss structure to the column structure, the trilateral bracing structure being separable from the truss structure and the column structure;

wherein the trilateral bracing structure is removable as a unit from the truss structure and the column structure without removing the truss structure from the column structure;

wherein the column structure and the trilateral bracing structure form a pocket therebetween for receiving one of the end portions of the truss structure;

wherein a lower end of the trilateral bracing structure is attached to the column structure below the bottom chord of the truss structure, and an upper end of the trilateral bracing structure is attached to the truss structure at a location that is above the bottom chord of the truss structure;

wherein the trilateral bracing structure comprises:

a bridging element attached to the column structure and the truss structure; and a first element and a second element attached together to form an apex attached to a bottom chord element of the truss structure at a location that is horizontally spaced from the column structure.

2. The building assembly of claim 1 wherein the trilateral bracing structure does not form an integral part of the column structure or the truss structure such that the truss structure is supportable on the column structure without the trilateral bracing structure.

3. The building assembly of claim 1 wherein the column structure includes at least two board elements being attached together face to face, an upper end of a first board element having a vertical height higher than a vertical height of an upper end of a second board element.

4. The building assembly of claim 1 wherein the trilateral bracing structure is substantially triangular.

5. The building assembly of claim 1 wherein the trilateral bracing structure has three corners, and wherein the bracing structure includes a plurality of board elements with a said board element extending from each said corner to an adjacent said corner, each said board element extending continuously from one said corner to the adjacent said corner.

6. The building assembly of claim 5 wherein two of said board elements abut against each other at each of said corners of the trilateral bracing structure.

7. The building assembly of claim 1 wherein the trilateral bracing structure has three sides extending between three corners.

8. A building assembly for forming a frame of a building, the building assembly comprising:

at least two elongated column structures;

a truss structure supported on the column structures, the truss structure having opposite end portions resting on the column structures at horizontally spaced locations; and a trilateral bracing structure attached to the truss structure and one of the column structures to tie the truss structure to the column structure, the trilateral bracing structure being separable from the truss structure and the column structure;

wherein the trilateral bracing structure is removable as a unit from the truss structure and the column structure without removing the truss structure from the column structure; and wherein the column structure and the trilateral bracing structure form a pocket therebetween for receiving one of the end portions of the truss structure;

wherein the trilateral bracing structure comprises:

a bridging element attached to the column structure and the truss structure; and a first element and a second element attached together to form an apex attached to a bottom chord element of the truss structure at a location that is horizontally spaced from the column structure;

wherein a lower end of the trilateral bracing structure is attached to the column structure below the bottom chord of the truss structure, and an upper end of the trilateral bracing structure is attached to the truss structure at a location that is above the bottom chord of the truss structure.

9. A building assembly for forming a frame of a building, the building assembly comprising:

at least two elongated column structures;

a truss structure supported on the column structures, the truss structure having opposite end portions resting on the column structures at horizontally spaced locations; and a trilateral bracing structure attached to the truss structure and one of the column structures to tie the truss structure to the column structure, the trilateral bracing structure being separable from the truss structure and the column structure;

wherein the trilateral bracing structure is removable as a unit from the truss structure and the column structure without removing the truss structure from the column structure; and wherein the column structure and the trilateral bracing structure form a pocket therebetween for receiving one of the end portions of the truss structure;

wherein the trilateral bracing structure comprises:

a bridging element attached to the column structure and the truss structure; and a first element and a second element attached together to form an apex attached to a bottom chord element of the truss structure at a location that is horizontally spaced from the column structure;

wherein the truss structure includes the bottom chord and a substantially vertically-oriented end element aligned with a longitudinal axis of the column structure, and wherein a lower end of the trilateral bracing structure is attached to the column structure below the bottom chord of the truss structure, and an upper end of the trilateral bracing structure is aligned with and attached to the end element of the truss structure at a location that is above the bottom chord of the truss structure.

10. A building assembly for forming a frame of a building, the building assembly comprising:

at least two elongated column structures;

a truss structure supported on the column structures, the truss structure having opposite end portions resting on the column structures at horizontally spaced locations; and a trilateral bracing structure attached to the truss structure and one of the column structures to tie the truss structure to the column structure, the trilateral bracing structure being separable from the truss structure and the column structure;

wherein the trilateral bracing structure is removable as a unit from the truss structure and the column structure without removing the truss structure from the column structure; and wherein the column structure and the trilateral bracing structure form a pocket therebetween for receiving one of the end portions of the truss structure;

wherein the trilateral bracing structure comprises:

a bridging element attached to the column structure and the truss structure; and a first element and a second element attached together to form an apex attached to a bottom chord element of the truss structure at a location that is horizontally spaced from the column structure;

wherein the bridging element has a length, and approximately one-half of the length being abutted against the column structure and approximately one-half of the length being abutted against the truss structure.

11. A kit for forming a frame of a building, the kit comprising:

at least two elongated column structures, the at least one column structure including at least two board elements;

a truss structure supportable on the column structures, the truss structure having opposite end portions restable on the column structures at horizontally spaced locations; and a trilateral bracing structure configured for removable attachment to the truss structure and one of the column structures to tie the truss structure to the column structure, the trilateral bracing structure being a separate piece from the truss structure and the column structure, the trilateral bracing structure having three corners, the bracing structure including a plurality of board elements with a said board element extending from each said corner to an adjacent said corner, each said board element extending continuously from one said corner to the adjacent said corner;

wherein the trilateral bracing structure is configured to be removable as a unit from the truss structure and one of the column structures without removing the truss structure from said one of the column structures;

wherein the column structure and the trilateral bracing structure are configured to form a pocket therebetween for receiving one of the end portions of the truss structure;

wherein the trilateral bracing structure is configured such that a lower end of the trilateral bracing structure is attachable to the column structure below the bottom chord of the truss structure, and the trilateral bracing structure is configured such that an upper end of the trilateral bracing structure is attachable to the truss structure at a location that is above the bottom chord of the truss structure;

wherein the trilateral bracing structure comprises:

a bridging element for attaching to the column structure and the truss structure; and a first element and a second element each attached to the bridging element and attached together to form an apex for attachment to a bottom chord element of the truss structure at a location that is horizontally spaced from the column structure.

12. The kit of claim 11 wherein the trilateral bracing structure does not form an integral part of the column structure or the truss structure such that the truss structure is supportable on the column structure without the trilateral bracing structure.

13. The kit of claim 11 wherein the column structure includes at least two board elements being positioned face to face, an upper end of a first board element having a vertical height higher than a vertical height of an upper end of a second board element.

14. The kit of claim 11 wherein the trilateral bracing structure is substantially triangular.

15. The building assembly of claim 11 wherein two of said board elements abut against each other at each of said three corners of the trilateral bracing structure.

16. A building assembly for forming a frame of a building, the building assembly comprising:

at least two elongated column structures;

a truss structure supported on the column structures, the truss structure having opposite end portions resting on the column structures at horizontally spaced locations; and a trilateral bracing structure attached to the truss structure and one of the column structures to tie the truss structure to the column structure, the trilateral bracing structure being separable from the truss structure and the column structure;

wherein the trilateral bracing structure is removable as a unit from the truss structure and the column structure without removing the truss structure from the column structure; and wherein the column structure and the trilateral bracing structure form a pocket therebetween for receiving one of the end portions of the truss structure;

wherein the trilateral bracing structure is formed of at least three board elements, each of the board elements having at least one face, the face of each board element overlying at least one of the truss structure and column structures.

* * * * *